US012037995B2

(12) United States Patent
Jeong et al.

(10) Patent No.: US 12,037,995 B2
(45) Date of Patent: Jul. 16, 2024

(54) SWASH PLATE COMPRESSOR

(71) Applicant: Hanon Systems, Daejeon (KR)

(72) Inventors: You Cheol Jeong, Daejeon (KR); Eun Gi Son, Daejeon (KR); Hew Nam Ahn, Daejeon (KR); Jun Ha Yoo, Daejeon (KR); Je Su Yun, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 412 days.

(21) Appl. No.: 17/309,148

(22) PCT Filed: Dec. 2, 2019

(86) PCT No.: PCT/KR2019/016842
§ 371 (c)(1),
(2) Date: Oct. 6, 2021

(87) PCT Pub. No.: WO2020/122489
PCT Pub. Date: Jun. 18, 2020

(65) Prior Publication Data

US 2022/0074395 A1 Mar. 10, 2022

(30) Foreign Application Priority Data

Dec. 12, 2018 (KR) ..... 10-2018-0159838

(51) Int. Cl.
*F04B 39/12* (2006.01)
*F04B 27/10* (2006.01)
(Continued)

(52) U.S. Cl.
CPC ..... *F04B 39/125* (2013.01); *F04B 27/1081* (2013.01); *F04B 27/1804* (2013.01);
(Continued)

(58) Field of Classification Search
CPC ..... F04B 1/146; F04B 27/10; F04B 27/1081; F04B 27/1804; F04B 39/1066;
(Continued)

(56) References Cited

U.S. PATENT DOCUMENTS 6,290,468 B1 * 9/2001 Kato ..... F04B 27/1804 91/473
2015/0300711 A1 * 10/2015 Taguchi ..... F04B 27/10 92/78

FOREIGN PATENT DOCUMENTS

CN 104234968 A 12/2014
JP 2003013848 A 1/2003
(Continued)

OTHER PUBLICATIONS

JP2016070167 translation (Year: 2023).*

*Primary Examiner* — Charles G Freay
*Assistant Examiner* — David N Brandt
(74) *Attorney, Agent, or Firm* — Shumaker, Loop & Kendrick, LLP; James D. Miller

(57) ABSTRACT

A swash plate compressor includes a cylinder block accommodating a piston for compressing a refrigerant, a front housing coupled to the cylinder block and having a crank chamber, a rear housing having a suction chamber and a discharge chamber and coupled to the cylinder block, and a suction reed plate inserted between a valve plate and the cylinder block. The swash plate compressor includes: a first orifice hole through which the refrigerant in the crank chamber passes; a second orifice hole communicating between the first orifice hole and the suction chamber; an intermediate flow path configured to connect the first orifice hole and the second orifice hole; and the valve plate inserted into the rear housing and having a suction chamber pressure-maintaining space connected to the suction chamber and
(Continued)

configured to maintain a pressure equal to a pressure in the suction chamber.

17 Claims, 14 Drawing Sheets

(51) Int. Cl.
*F04B 27/18* (2006.01)
*F04B 39/10* (2006.01)
*F04B 53/10* (2006.01)

(52) U.S. Cl.
CPC ..... *F04B 39/1066* (2013.01); *F04B 39/123* (2013.01); *F04B 53/10* (2013.01); *F04B 27/1009* (2013.01); *F04B 39/1073* (2013.01)

(58) Field of Classification Search
CPC ..... F04B 39/123; F04B 39/125; F04B 53/10; F04B 27/1009; F04B 39/1073; F04B 39/108; F04B 39/1086; F04B 53/1047
See application file for complete search history.

(56) References Cited

FOREIGN PATENT DOCUMENTS

| | | | | | |
|---|---|---|---|---|---|
| JP | 2005105975 | A | | 4/2005 | |
| JP | 2010007588 | A | | 1/2010 | |
| JP | 2011032916 | A | | 2/2011 | |
| JP | 2011064240 | A | | 3/2011 | |
| JP | 2015203346 | A | | 11/2015 | |
| JP | 2016070167 | | * | 5/2016 | ..... F04B 39/10 |
| JP | 2016070167 | A | | 5/2016 | |
| JP | 2018112118 | A | | 7/2018 | |
| KR | 20120100189 | A | | 9/2012 | |
| KR | 20150008587 | A | | 1/2015 | |
| KR | 20180095457 | A | | 8/2018 | |
| WO | 2017035289 | A1 | | 3/2017 | |

* cited by examiner

SWASH PLATE COMPRESSOR

CROSS-REFERENCE TO RELATED PATENT APPLICATIONS

This patent application is a United States national phase patent application based on PCT/KR2019/016842 filed on Dec. 2, 2019, which claims the benefit of Korean Patent Application No. 10-2018-0159838 filed on Dec. 12, 2018, the entire contents of both of which are hereby incorporated herein by reference.

TECHNICAL FIELD

The present disclosure relates to a swash plate compressor, and more particularly, to a swash plate compressor capable of improving efficiency of the compressor by preventing an unnecessary loss of refrigerant gas.

BACKGROUND ART

In general, a compressor applied to an air conditioning system serves to draw in refrigerant gas having passed through an evaporator, compress the refrigerant gas to a high-temperature, high-pressure state, and then discharge the compressed refrigerant gas to a condenser. There are used various types of compressors such as a reciprocating compressor, a rotary compressor, a scroll compressor, and a swash plate compressor.

Among these compressors, a compressor using an electric motor as a power source is typically referred to as an electric compressor, and among types of compressors, the swash plate compressor is widely used for air conditioning devices for vehicles.

The swash plate compressor has a disc-shaped swash plate inclinedly installed on a driving shaft that rotates by being provided with power from an engine. The swash plate compressor operates on the principle that the swash plate is rotated by the driving shaft and a plurality of pistons rectilinearly reciprocates in a cylinder by the rotation of the swash plate to draw in or compress the refrigerant gas and then discharge the compressed refrigerant gas. In particular, a variable capacity swash plate compressor disclosed Korean Patent Laid-Open No. 2012-0100189 is configured such that an inclination angle of a swash plate is changed, the amount of reciprocation of a piston is changed by the change in inclination angle of the swash plate, and thus the amount of refrigerant to be discharged is adjusted.

The inclination angle of the swash plate may be controlled using a control pressure Pc which is a pressure in a control chamber (crank chamber). Specifically, as a part of the compressed refrigerant discharged to a discharge chamber is introduced into the control chamber, the pressure in the control chamber may be adjusted, and the inclination angle of the swash plate may be changed depending on the control pressure Pc which is the pressure in the control chamber.

In this case, because not only the compressed refrigerant discharged to the discharge chamber, but also the refrigerant, which leaks between the piston and a cylinder, is introduced into the control chamber, it is necessary to discharge the introduced refrigerant to a suction chamber in order to maintain an appropriate pressure. To this end, the variable capacity swash plate compressor has an orifice hole that allows the control chamber and the suction chamber to communicate with each other, and the refrigerant in the control chamber may be reintroduced into the suction chamber through the orifice hole.

However, there may occur a problem in that efficiency of the compressor deteriorates as the amount of refrigerant discharged through the orifice hole increases. Therefore, it is necessary to minimize the amount of refrigerant to be discharged through the orifice hole.

However, in the case of the variable capacity swash plate compressor in the related art, the amount of refrigerant discharged through the orifice hole increases due to a leakage of the refrigerant gas through the orifice hole even in a situation in which a difference between a control pressure and a suction pressure is kept constant, and as a result, there is a problem in that efficiency of the compressor may deteriorate.

SUMMARY

Accordingly, an object of the present disclosure is to provide a swash plate compressor capable of improving efficiency of the compressor by preventing an unnecessary loss of refrigerant gas.

One aspect of the present disclosure may provide a swash plate compressor including a cylinder block configured to accommodate a piston for compressing a refrigerant, a front housing coupled to a front side of the cylinder block and having a crank chamber, a rear housing having a suction chamber and a discharge chamber and coupled to a rear side of the cylinder block, a gasket inserted into the cylinder block, and a suction reed plate inserted between a valve plate and the cylinder block, the swash plate compressor including: a first orifice hole through which the refrigerant in the crank chamber passes; a second orifice hole communicating with the suction chamber and configured to discharge the refrigerant passing through the first orifice hole to the suction chamber; an intermediate flow path configured to connect the first orifice hole and the second orifice hole; and the valve plate inserted into the rear housing and having a suction chamber pressure-maintaining space connected to the suction chamber and configured to maintain a pressure equal to a pressure in the suction chamber.

The suction chamber pressure-maintaining space may be recessed in the valve plate.

The valve plate may include: a first valve plate through hole penetratively formed in the valve plate to connect the suction chamber pressure-maintaining space and the suction chamber; and a second valve plate through hole penetratively formed in the valve plate and spaced apart from the first valve plate through hole.

The swash plate compressor may further include a variable reed having one end connected to the suction reed plate, and the other end formed as a free end, in which an opening degree of the variable reed is changed in accordance with a pressure of the refrigerant.

The variable reed may be provided to be displaced into the suction chamber pressure-maintaining space.

The first valve plate through hole may be provided to be closed when the variable reed is displaced into the suction chamber pressure-maintaining space.

The gasket may include a gasket hole formed to face the variable reed such that the refrigerant passes through the gasket hole.

The variable reed may be formed to close the gasket hole and may include a variable reed hole penetratively formed to face the gasket hole.

The variable reed hole may be spaced apart from the first valve plate through hole in an axial direction of the first valve plate through hole with the suction chamber pressure-maintaining space interposed therebetween, and a part of the variable reed hole, which is adjacent to the suction chamber pressure-maintaining space, may overlap a portion of the first valve plate through hole which is adjacent to the suction chamber pressure-maintaining space.

An end of the variable reed may come into contact with a portion between the first through hole and the second through hole when the variable reed is opened.

The variable reed may be formed to open at least a part of the gasket hole.

The cylinder block may have a through-portion extending between the crank chamber and the first orifice hole.

The first orifice hole may be formed in the suction reed plate.

The first orifice hole may be formed along a part of an outer circumferential portion of the variable reed.

The intermediate flow path may include a buffer space communicating with the suction chamber pressure-maintaining space.

The buffer space may be disposed between one end of the cylinder block and the gasket.

The buffer space may communicate with the second orifice hole.

According to the aspects of the present disclosure having the above-mentioned features, in the case in which the variable reed is opened by a difference between the control pressure and the suction pressure, no difference occurs between the suction pressure and the pressing force of the suction pressure to the variable reed, and as a result, it is possible to prevent a delay of opening of the variable reed caused by the difference between the suction pressure and the pressing force of the suction pressure to the variable reed, thereby improving controllability of the swash plate compressor. Therefore, the amount of loss of the refrigerant gas is reduced, thereby improving the efficiency of the compressor.

DETAILED DESCRIPTION OF THE EMBODIMENTS

Figure 1:
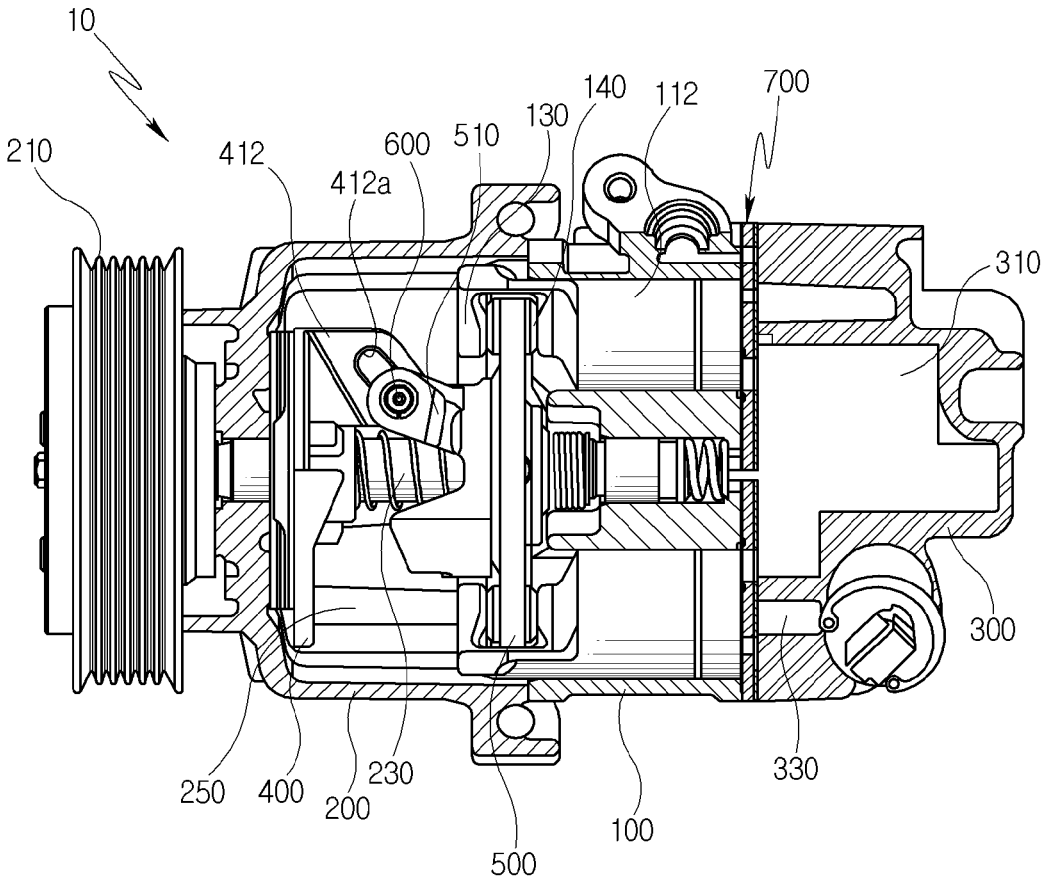
FIG. 1 is a cross-sectional view illustrating an example of a swash plate compressor.

In order to sufficiently understand the present disclosure, advantages in operation of the present disclosure, and the object to be achieved by carrying out the present disclosure, reference needs to be made to the accompanying drawings for illustrating embodiments of the present disclosure and contents disclosed in the accompanying drawings.

Specific structural or functional descriptions of the embodiments according to the concept of the present disclosure disclosed in the present specification are exemplified only for the purpose of explaining the embodiments according to the concept of the present disclosure, the embodiments according to the concept of the present disclosure may be carried out in various forms, and the present disclosure is not limited to the embodiments described in the present specification.

Because the embodiments according to the concept of the present disclosure may be variously changed and may have various forms, the embodiments will be illustrated in the drawings and described in detail in the present specification. However, the descriptions of the embodiments are not intended to limit the embodiments according to the concept of the present disclosure to the specific embodiments, and the present disclosure covers all modifications, equivalents, and alternatives falling within the spirit and technical scope of the present disclosure.

The terms such as "first," "second," and other numerical terms may be used herein only to describe various elements, but these elements should not be limited by these terms. These terms are used only for the purpose of distinguishing one constituent element from other constituent elements. For example, without departing from the scope according to the concept of the present disclosure, the first constituent element may be referred to as the second constituent element, and similarly, the second constituent element may also be referred to as the first constituent element.

When one constituent element is described as being "connected" or "coupled" to another constituent element, it should be understood that one constituent element can be connected or coupled directly to another constituent element, and an intervening constituent element can also be present between the constituent elements. When one constituent element is described as being "connected directly to" or "coupled directly to" another constituent element, it should be understood that no intervening constituent element is present between the constituent elements. Other expressions, that is, "between" and "just between" or "adjacent to" and "directly adjacent to", for explaining a relationship between constituent elements, should be interpreted in a similar manner.

The terms used in the present specification are used to just describe a specific embodiment and do not intend to limit the present disclosure. Singular expressions include plural expressions unless clearly described as different meanings in the context. In the present application, it will be appreciated that terms "including" and "having" are intended to designate the existence of characteristics, numbers, steps, operations, constituent elements, and components described in the specification or a combination thereof, and do not exclude a possibility of the existence or addition of one or more other characteristics, numbers, steps, operations, constituent elements, and components, or a combination thereof in advance.

Unless otherwise defined, all terms used herein, including technical or scientific terms, have the same meaning as commonly understood by those skilled in the art to which the present disclosure pertains. The terms such as those defined in a commonly used dictionary should be interpreted as having meanings consistent with meanings in the context of related technologies and should not be interpreted as ideal or excessively formal meanings unless explicitly defined in the present specification.

Hereinafter, the present disclosure will be described in detail by describing the embodiments of the present disclosure with reference to the accompanying drawings. Like reference numerals indicated in the respective drawings refer to like members.

Figure 2:
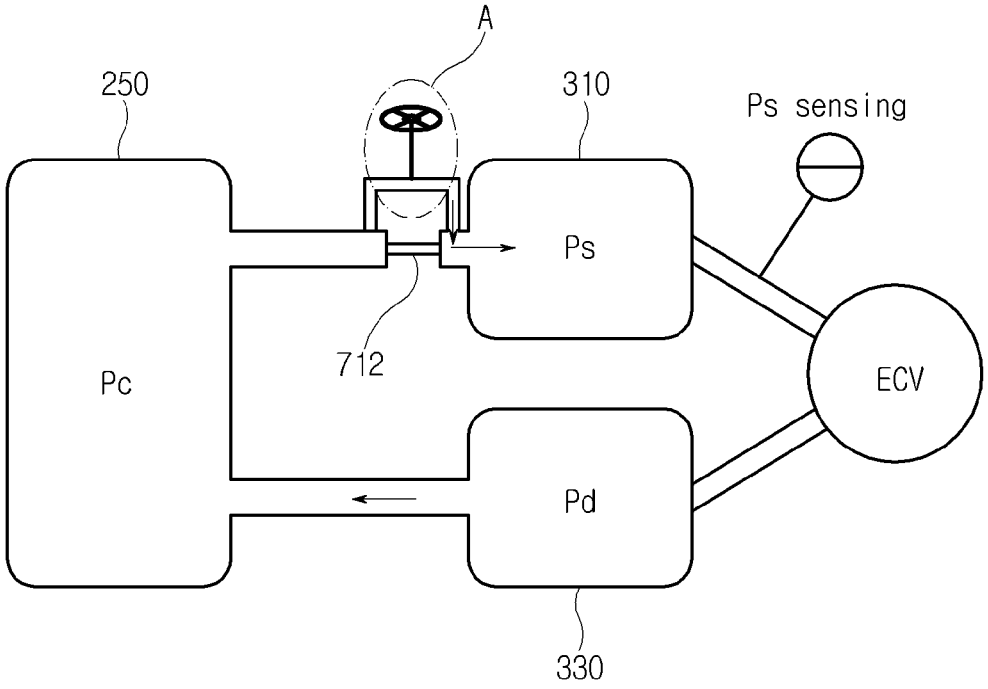
FIG. 2 is a schematic view illustrating a pressure flow in the swash plate compressor illustrated in FIG. 1.

FIG. 1 is a cross-sectional view illustrating an example of a swash plate compressor, and FIG. 2 is a schematic view illustrating a pressure flow in the swash plate compressor illustrated in FIG. 1.

As illustrated in FIGS. 1 and 2, a swash plate compressor 10 includes a cylinder block 100 provided to define an external appearance, a front housing 200 coupled to a front side of the cylinder block 100, a rear housing 300 coupled to a rear side of the cylinder block 100, and a drive unit provided in the cylinder block 100, the front housing 200, and the rear housing 300.

In other words, the swash plate compressor 10 according to the embodiment of the present disclosure includes: the cylinder block 100 configured to accommodate pistons 112 for compressing a refrigerant; the front housing 200 coupled to the front side of the cylinder block 100 and having a crank chamber 250; the rear housing 300 having a suction chamber 310 and a discharge chamber 330 and coupled to the rear side of the cylinder block 100; a gasket 730 inserted into the cylinder block 100, a suction reed plate 750 inserted between a valve plate 710 and the cylinder block 100, and the drive unit provided inside the above-mentioned components.

The drive unit includes a pulley 210 configured to be supplied with power from an engine, a driving shaft 230 rotatably installed at a center of the front housing 200 and coupled to the pulley 210, a rotor 400 coupled to the driving shaft 230, and a swash plate 500.

The piston 112 is connected to a connection part 130, and a pair of hemispherical shoes 140 is provided in the connection part 130. The swash plate 500 is installed in such a manner that a part of an outer circumference thereof is inserted between the shoes 140, and the outer circumference of the swash plate 500 passes through the shoes 140 while the swash plate 500 rotates. The swash plate 500 is operated with an inclination at a predetermined angle with respect to the driving shaft 230, and as a result, the shoes 140 and the connection part 130 rectilinearly reciprocate in the cylinder block 100 by the inclination of the swash plate 500. The piston 112 also rectilinearly reciprocates forward and rearward in a longitudinal direction in a cylinder bore along with the movement of the connection part 130, such that the refrigerant gas is compressed by the reciprocation of the piston 112.

The swash plate 500 is rotatably coupled to the rotor 400 by a hinge 600 in a state in which the swash plate 500 is inserted into the driving shaft 230, and a spring (no reference numeral) is provided between the swash plate 500 and the rotor 400 and elastically support the swash plate 500. Since the swash plate 500 is rotatably coupled to the rotor 400, the swash plate 500 also rotates along with the rotations of the driving shaft 230 and the rotor 400.

Meanwhile, the rear housing 300 includes a control valve (not illustrated), the suction chamber 310 into which the refrigerant is introduced, and the discharge chamber 330 from which the refrigerant is discharged. A valve assembly 700 is installed between the rear housing 300 and the crank chamber 250. Further, a discharge assembly 800 is provided at a rear end of the valve assembly 700.

The refrigerant gas in the suction chamber 310 is introduced into the cylinder bore, and the refrigerant gas compressed by the piston 112 is discharged to the discharge chamber 330. The valve assembly 700 allows the discharge chamber 330, from which the refrigerant is discharged, to communicate with the crank chamber 250 provided in the front housing 200, and the valve assembly 700 regulates a discharge rate and a pressure of the refrigerant by adjusting the inclination angle of the swash plate 500 by changing a difference between a refrigerant suction pressure in the cylinder bore and a gas pressure in the crank chamber 250.

The swash plate compressor includes a variable orifice module provided to prevent an unnecessary outflow of the refrigerant when the difference between a control pressure Pc in the crank chamber 250 and a suction pressure Ps in the suction chamber 310 is kept constant. The variable orifice module will be described below in detail.

When a refrigerant load is large, the pressure in the crank chamber 250 is controlled and decreased by the control valve, and the inclination angle of the swash plate 500 is also increased. When the inclination angle of the swash plate 500 is increased, the stroke of the piston is also increased, such that the discharge rate of the refrigerant is increased.

On the contrary, when a cooling load is small, the pressure in the crank chamber 250 is controlled and increased by the control valve, and the inclination angle of the swash plate 500 is also decreased, such that the swash plate 500 becomes almost perpendicular to the driving shaft 230. When the inclination angle of the swash plate 500 is decreased, the stroke of the piston is also decreased, such that the discharge rate of the refrigerant is decreased.

At the time of the initial operation of the compressor or in order to maximize a stroke length by increasing the inclination angle of the swash plate 500, the pressure in the crank chamber 250 needs to be decreased. To this end, the typical swash plate compressor has an orifice hole to discharge the high-pressure refrigerant in the crank chamber 250 to the suction chamber. When a size of the orifice hole is large, the refrigerant may be quickly discharged to the suction chamber, but even if unnecessary, a loss of the refrigerant may occur.

That is, when the difference between the control pressure Pc which is the pressure in the crank chamber 250 and the suction pressure Ps which is the pressure in the suction chamber (hereinafter, referred to as a differential pressure between the crank chamber and the suction chamber) is increased, the refrigerant in the crank chamber 250 is introduced into the suction chamber 310. However, as illustrated in FIG. 2, when the differential pressure between the crank chamber 250 and the suction chamber 310 is kept constant, the refrigerant may be discharged from the crank chamber 250 to the suction chamber through the orifice hole. Therefore, in order to improve the efficiency of the compressor, it is necessary to minimize the amount of refrigerant discharged to the suction chamber through the orifice hole when the differential pressure between the crank chamber 250 and the suction chamber 310 is kept constant.

In addition, when the pressure in the crank chamber 250 is increased to a predetermined pressure or higher, the variable orifice module is opened by the pressure to move the refrigerant in the crank chamber 250 to the suction chamber 310, thereby decreasing the pressure in the crank chamber 250.

The variable orifice module according to the present disclosure includes two orifice holes, that is, first and second orifice holes, and an intermediate flow path that allows the first and second orifice holes to communicate with each other. The first orifice hole includes a variable reed to change an opening degree depending on the pressure of the refrigerant. Further, the intermediate flow path may include a suction chamber pressure-maintaining space and a buffer space (first embodiment) or include a single suction chamber pressure-maintaining space (second embodiment). In each embodiment, it is possible to adopt a variety of variable reeds. Further, the refrigerant in the crank chamber may be introduced into the first orifice hole through a through-portion formed in the cylinder block or may be introduced through a hollow flow path penetratively formed in the driving shaft. In this case, the hollow flow path may be connected to the buffer space.

Figure 3:
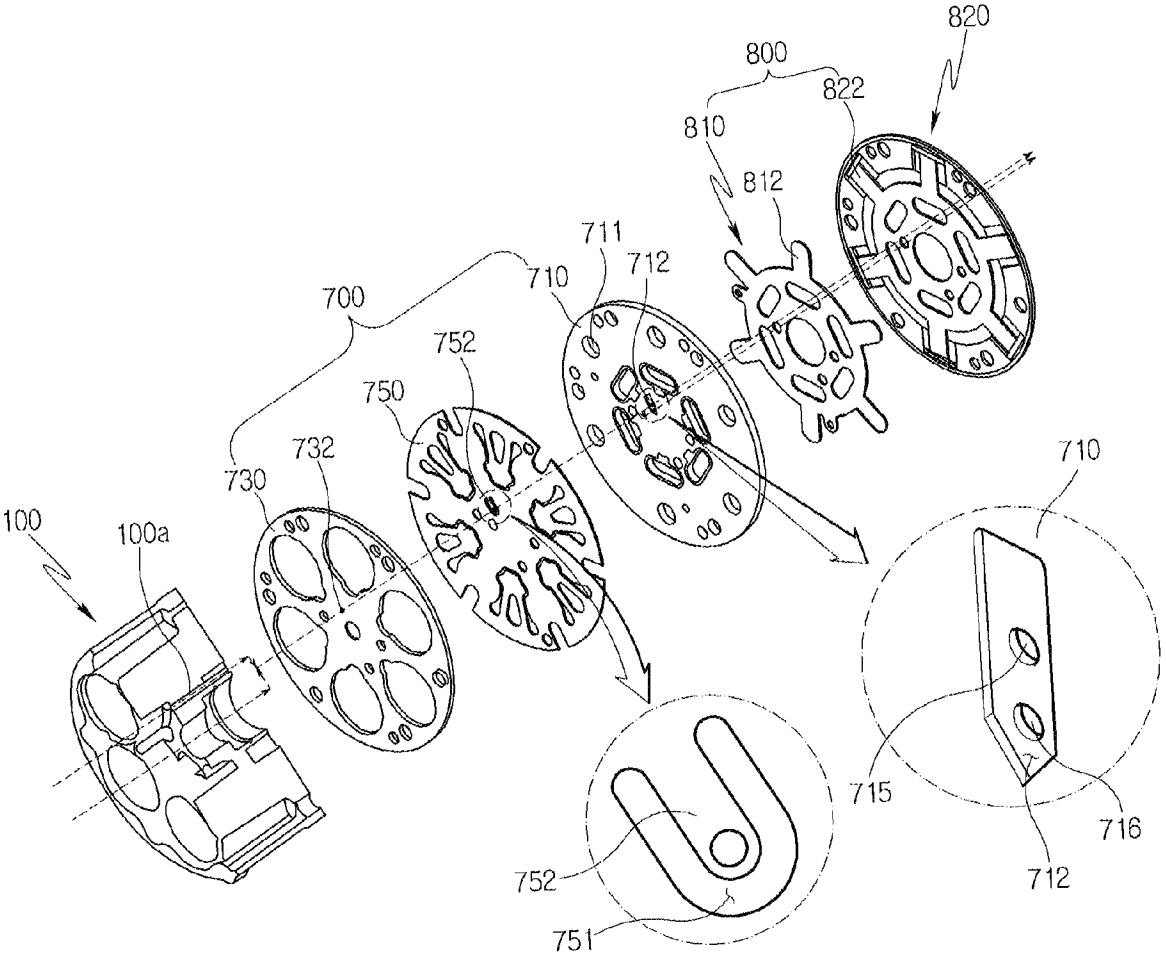
FIG. 3 is an exploded perspective view of a refrigerant flow path of a swash plate compressor according to a first embodiment of the present disclosure.
Figure 4:
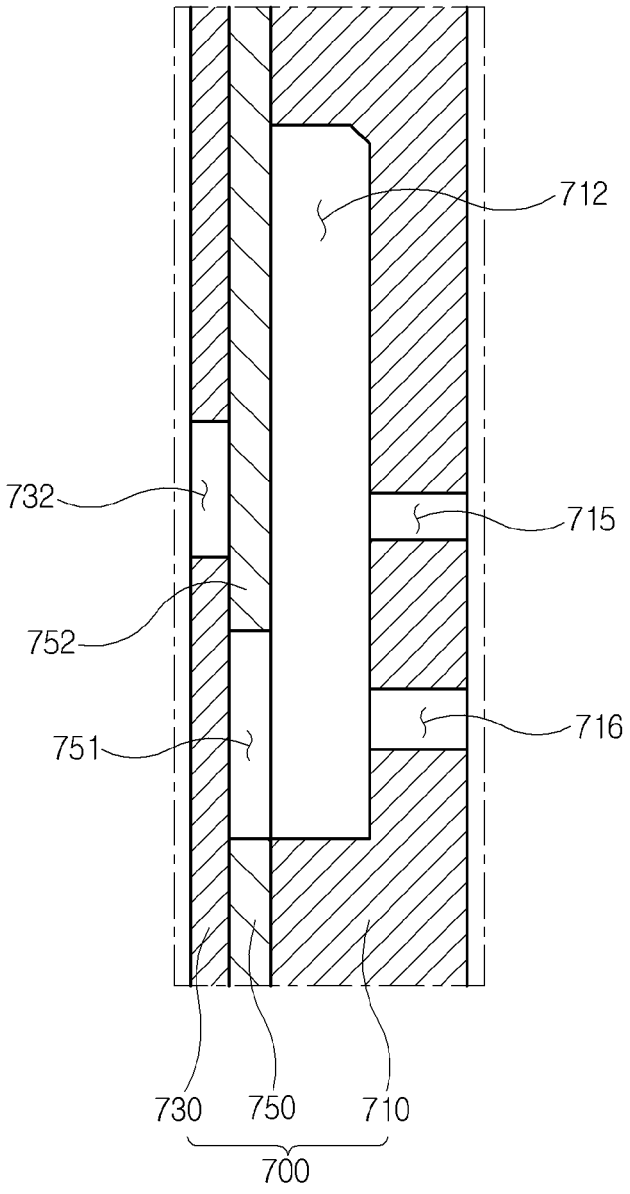
FIG. 4 is a cross-sectional view illustrating a main part of the swash plate compressor illustrated in FIG. 3.
Figure 5:
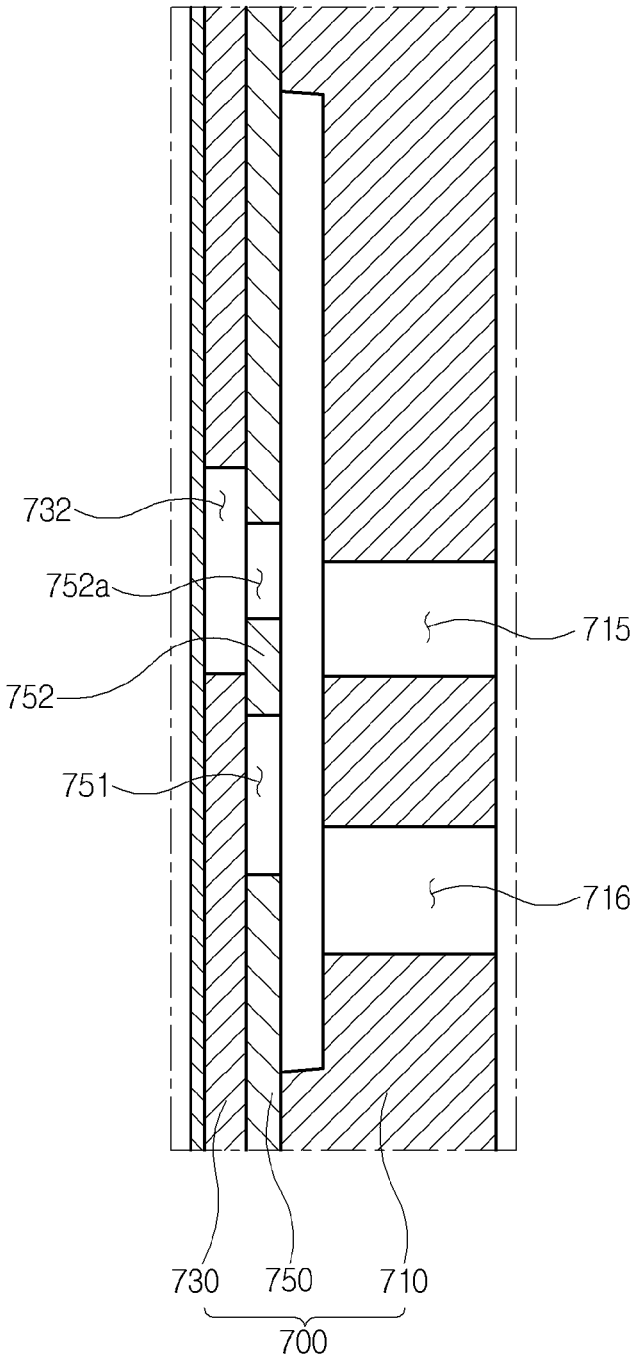
FIG. 5 is a cross-sectional view illustrating a main part of a swash plate compressor according to a second embodiment.

FIG. 3 is an exploded perspective view of a refrigerant flow path in the swash plate compressor according to the first embodiment of the present disclosure, FIG. 4 is a cross-sectional view illustrating a main part of the swash plate compressor illustrated in FIG. 3, and FIG. 5 is a cross-sectional view illustrating a main part of the swash plate compressor according to the second embodiment.

As illustrated in FIGS. 3 to 5, the valve assembly 700 includes the valve plate 710 inserted into the rear housing 300, the gasket 730 inserted into the cylinder block 100, and the suction reed plate 750 inserted between the valve plate 710 and the gasket 730. Further, the discharge assembly 800 includes: a discharge reed 810 having a plurality of discharge reed plates 812 each functioning as a discharge valve for guiding the refrigerant compressed in the cylinder to the discharge chamber 330 only when the pressure of the refrigerant is higher than a predetermined pressure; and a discharge gasket 820 having a retainer 822 provided to regulate the amount of movement of the discharge reed plate 812.

In this case, the discharge reed plates 812 provided in the discharge reed 810 are disposed to face a plurality of discharge holes 711 provided in the valve plate 710, such that when the pressure of the refrigerant in the cylinder is sufficiently increased, the discharge reed plates 812 are opened to discharge the refrigerant to the discharge chamber through the discharge holes.

On the basis of the flow of refrigerant, the cylinder block 100 has a through-portion 100*a* penetratively formed in the longitudinal direction of a driving shaft 230. The gasket 730 has a gasket hole 732 formed to correspond to the position of the through-portion 100*a*, and the suction reed plate 750 has a variable reed 752 formed to correspond to the position of the gasket hole 732. The valve plate 710 has the suction chamber pressure-maintaining space 712 formed to correspond to the position of the variable reed 752.

In addition, the valve plate 710 includes: a first valve plate through hole 715 penetrating the valve plate 710, connecting the suction chamber pressure-maintaining space 712 and the suction chamber 310, and making a pressure in the suction chamber pressure-maintaining space 712 equal to a pressure in the suction chamber 310; and a second valve plate through hole 716 penetrating the valve plate 710 at a position spaced apart from the first valve plate through hole 715, connecting the suction chamber pressure-maintaining space 712 and the suction chamber 310 and forming the second orifice hole.

As described above, the suction pressure Ps which is the pressure in the suction chamber 310 is kept equal to the pressure Ps in the suction chamber pressure-maintaining space 712 through the first valve plate through hole 715. When the control pressure Pc is higher than the pressure Ps in the suction chamber pressure-maintaining space 712, the control pressure Pc presses the variable reed 752, such that the variable reed 752 is deformed downward, as illustrated in FIGS. 9 to 14 in detail, to discharge the refrigerant in the control chamber. That is, since the pressure in the suction chamber pressure-maintaining space 712 is kept equal to the pressure in the suction chamber 310, it is possible to improve responsiveness of the variable reed 752 and thus to improve the operation of opening the variable reed 752, and it is possible to minimize an unnecessary outflow of the refrigerant gas by preventing a delay of opening of the variable reed 752. Therefore, the amount of loss of the refrigerant gas is reduced, thereby improving efficiency.

The gasket hole 732 has a shape corresponding to the shape of the variable reed 752 and is penetratively formed in the gasket 730. The gasket hole 732 functions as a passageway through which the refrigerant introduced from the crank chamber primarily passes. However, the gasket hole 732 may have any shape that enables the refrigerant to be transferred to the variable reed 752.

The suction chamber pressure-maintaining space 712 is a kind of accommodation space which is a flow space of the variable reed 752 when the variable reed 752 is deformed by the pressure of the refrigerant to open the gasket hole 732 during the flow of the refrigerant. The suction chamber pressure-maintaining space 712 is recessed from a surface of the valve plate 710 and formed on a plate surface facing the suction reed plate 750. In addition, the suction chamber pressure-maintaining space 712 defines a part of the intermediate flow path for supplying the refrigerant to the second orifice hole and also functions as a retainer for restricting the displacement of the variable reed 752. Therefore, the suction chamber pressure-maintaining space 712 needs to have a shape enough to sufficiently accommodate the variable reed 752, and a depth of the suction chamber pressure-maintaining space 712 may be appropriately selected in accordance with a thickness of the variable reed 752, and types, operating pressures, and flow rates of refrigerants to be supplied. That is, on the variable reed 752.

The first orifice hole 751 is defined as a space in which the variable reed 752 is disposed.

The first orifice hole 751 is formed by cutting a portion of the suction reed plate 750 and the variable reed 752 is disposed in the first orifice hole 751. Because the first orifice hole 751 is larger than the variable reed 752, a predetermined amount of refrigerant always passes through the first orifice hole 751 regardless of whether the variable reed 752 is opened or closed.

As illustrated in FIGS. 3 to 5 in detail, the refrigerant flows from the crank chamber 250 to the suction chamber 310 via the variable orifice module through the through-portion 100*a* formed in the cylinder block 100.

The refrigerant introduced into the crank chamber passes through the gasket hole 732 formed in the gasket 730 of the valve plate 710 and flows to the suction chamber pressure-maintaining space 712 of the valve plate 710 through the first orifice hole 751 formed in the suction reed plate 750. In this case, because the variable reed 752 disposed in the first orifice hole 751 is parallel with the surface of the suction reed plate, the first orifice hole 751 is formed along a part of an outer circumferential portion of the variable reed 752.

The refrigerant introduced into the suction chamber pressure-maintaining space 712 flows toward the center of the valve plate along the suction chamber pressure-maintaining space 712 and then flows into a buffer space 110 formed in an approximately central portion of the cylinder block 100. The buffer space 110 is a space defined by one end of the cylinder block 100 and the valve assembly 700 and has a volume significantly larger than an internal volume of the suction chamber pressure-maintaining space 712.

If the pressure in the crank chamber is increased to a predetermined value or higher, the variable reed 752 is displaced into the suction chamber pressure-maintaining space 712 by the pressure of the refrigerant.

When the pressure of the refrigerant is decreased as the refrigerant is discharged, the variable reed is returned back to the original position and the opening degree of the first orifice hole 751 is decreased again. As a result, it is possible to reduce the flow rate of the refrigerant discharged to the suction chamber through the orifice hole, thereby increasing the efficiency of the compressor. Here, a ratio between a minimum open area and a maximum open area may be arbitrarily set in accordance with an operating condition of the compressor.

The buffer space 110 has a very larger volume than the reed groove as described above. Therefore, the refrigerant flowing to the buffer space through the reed groove is expanded, such that the pressure of the refrigerant may be decreased even though the refrigerant is not discharged to the suction chamber. Moreover, when the refrigerant is excessively discharged to the suction chamber, the suction pressure is increased, which may also cause a deterioration in efficiency. However, by providing the buffer space, it is possible to reduce an excessive increase in pressure in the suction chamber. In addition, since the pressure of the refrigerant flowing through the reed groove immediately after the variable reed is displaced is rapidly increased, this may cause problems such as an occurrence of noise or an increase in flow resistance. However, these problems may be resolved by the buffer space.

Figure 6:
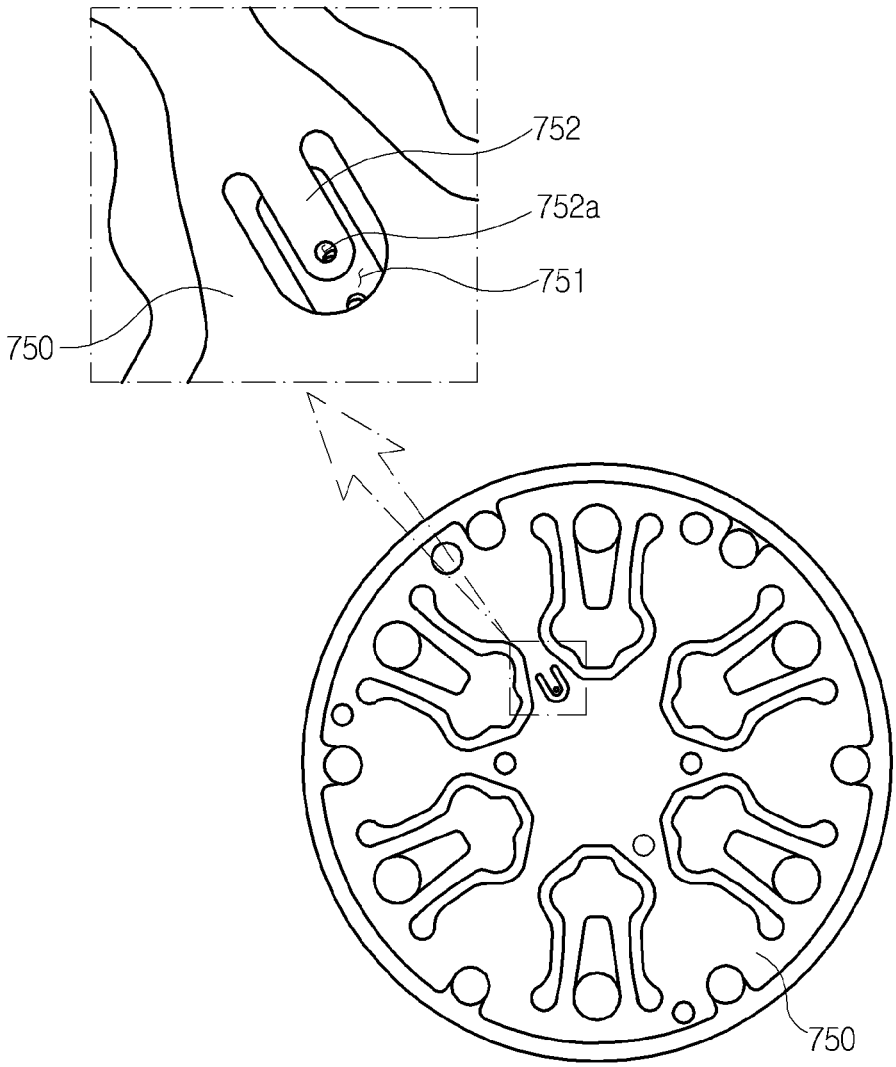
FIG. 6 is a view illustrating a variable reed applied to the swash plate compressor illustrated in FIG. 5.
Figure 7:
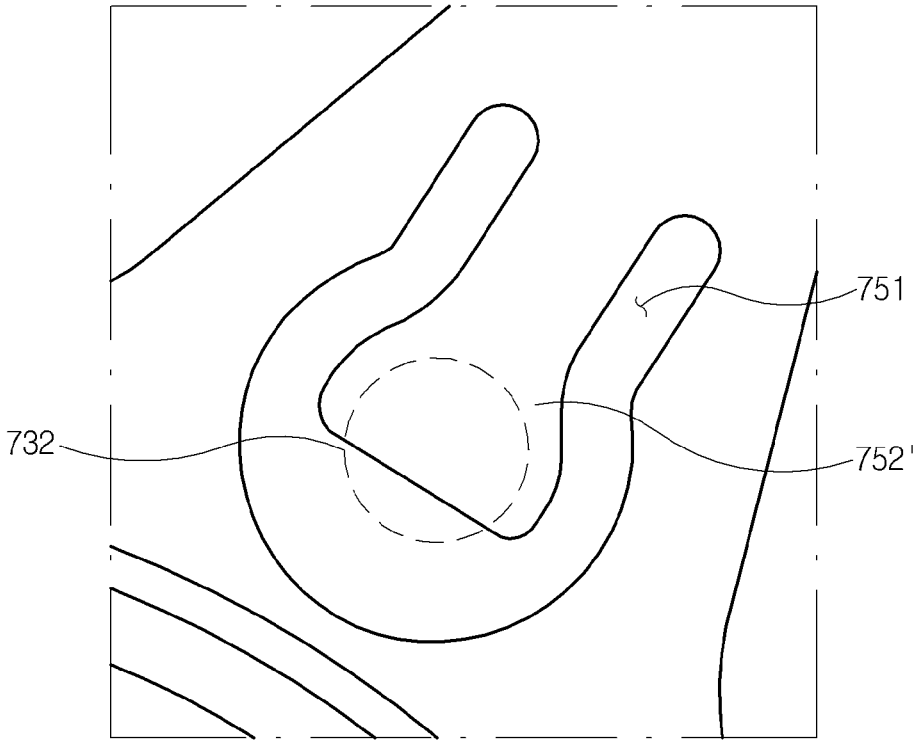
FIG. 7 is a view illustrating a variable reed according to a third embodiment of the present disclosure.
Figure 8:
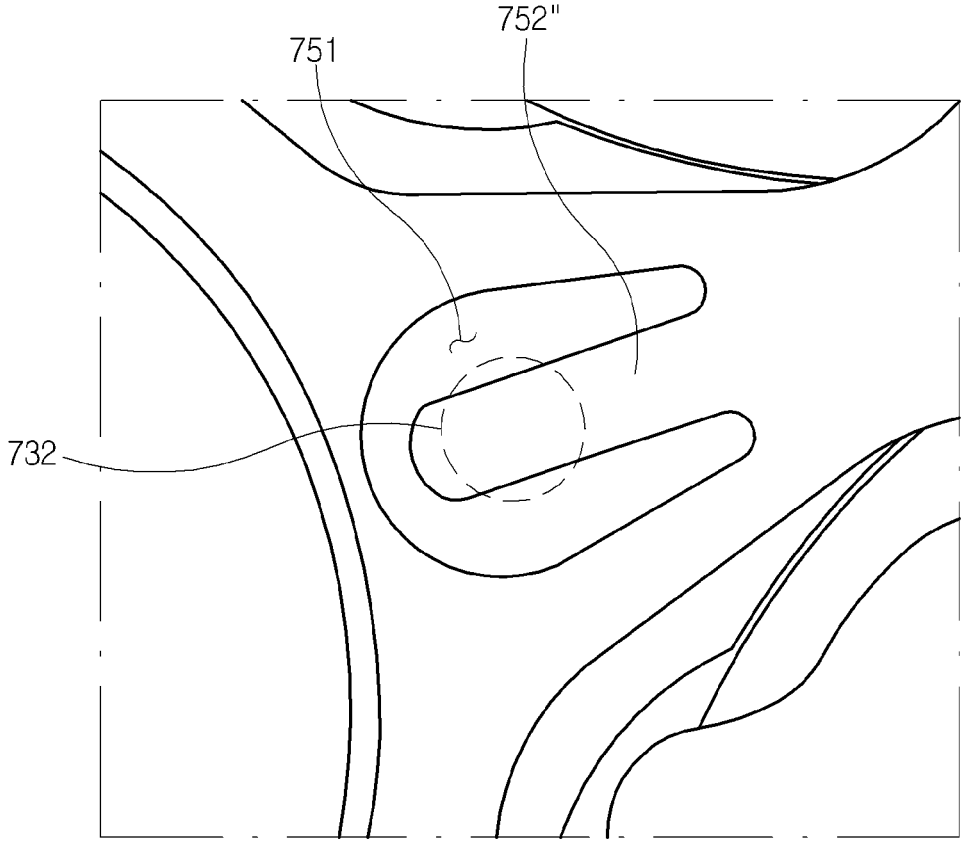
FIG. 8 is a view illustrating a variable reed according to a fourth embodiment of the present disclosure.

FIG. 6 is a view illustrating the variable reed applied to the swash plate compressor illustrated in FIG. 5, FIG. 7 is a view illustrating a variable reed according to a third embodiment of the present disclosure, and FIG. 8 is a view illustrating a variable reed according to a fourth embodiment of the present disclosure.

The above-mentioned variable reed 752 is opened toward the suction chamber pressure-maintaining space 712 at a predetermined pressure or higher and partially closes the first orifice hole 751 communicating with the through-portion 100*a* at the predetermined pressure or lower to reduce an orifice flow path communicating with the crank chamber 250 and the suction chamber 310. The variable reed 752 is opened when the pressure in the crank chamber 250 is increased, and the variable reed 752 has a reed hole 752*a* or is configured to partially open the flow path.

As illustrated in FIG. 6, one end of the variable reed 752 is formed integrally with the suction reed plate 750, the other end of the variable reed 752 extends to define a free end, and the free end typically has a circular shape. In this case, the free end has a diameter greater than a width of the fixed end, but the diameter of the free end is smaller than a width of the reed groove so that the displacement into the suction chamber pressure-maintaining space 712 may be made. In FIG. 6, the variable reed hole 752*a* is penetratively formed at the free end of the variable reed 752, and the gasket hole 732 is smaller than an area of the variable reed 752. Therefore, because the gasket hole 732 is fully closed by the variable reed 752 when there is no variable reed hole 752*a*, the variable reed hole 752*a* is formed such that a part of the refrigerant always flows. In addition, the variable reed hole 752*a* is provided to be smaller than a diameter of the gasket hole 732. In other words, the variable reed hole 752*a* may have an inner diameter smaller than an inner diameter of the gasket hole 732, thereby adjusting the flow of the refrigerant flowing along the inner diameter of the gasket hole 732. Further, the variable reed hole 752*a* may be disposed in a direction of the central axis of the gasket hole 732 so as to share the same central axis with the gasket hole 732. Since the variable reed hole 752*a* functions to reduce a pressure receiving area to which the pressure applied to the variable reed 752 is applied, this may affect the responsiveness of the variable reed. Therefore, it is possible to control the responsiveness of the variable reed by adjusting the position, number, and area of the variable reed hole(s) 752*a* in consideration of the dimension and material of the variable reed.

Meanwhile, the variable reed hole 752*a* may be removed in some cases, in which case a part of the gasket hole is always opened regardless of the position of the variable reed, such that the variable reed does not fully cover the gasket hole. For example, one end of the variable reed 752 is formed integrally with the suction reed plate 750, the other end of the variable reed 752 extends to define a free end, and the free end partially has a circular shape. Moreover, a tip of the free end has a rectilinear shape, such that a part of the gasket hole 732 is always kept opened regardless of the position of the variable reed.

Alternatively, one end of the variable reed 752 is formed integrally with the suction reed plate 750, and the other end of the variable reed 752 may be a free end extending in a bar shape. In this case, the variable reed 752 has a smaller width than the gasket hole 732, such that the refrigerant may flow to the first orifice hole through the left and right sides of the variable reed.

Figure 9:
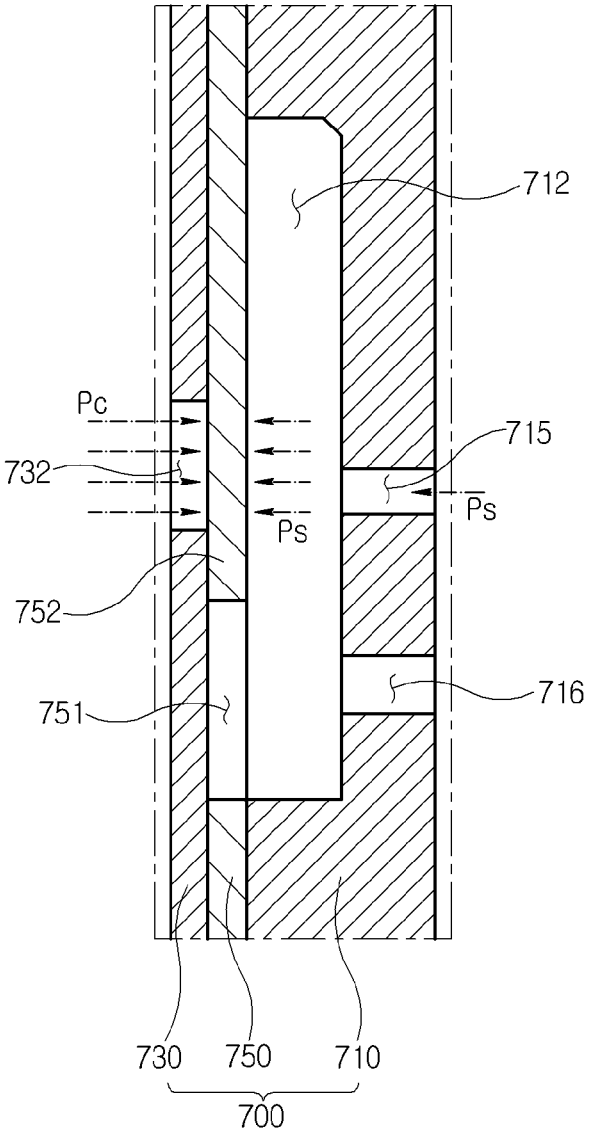
FIGS. 9 and 10 are views illustrating a process of operating the variable reed according to the first embodiment of the present disclosure.
Figure 10:
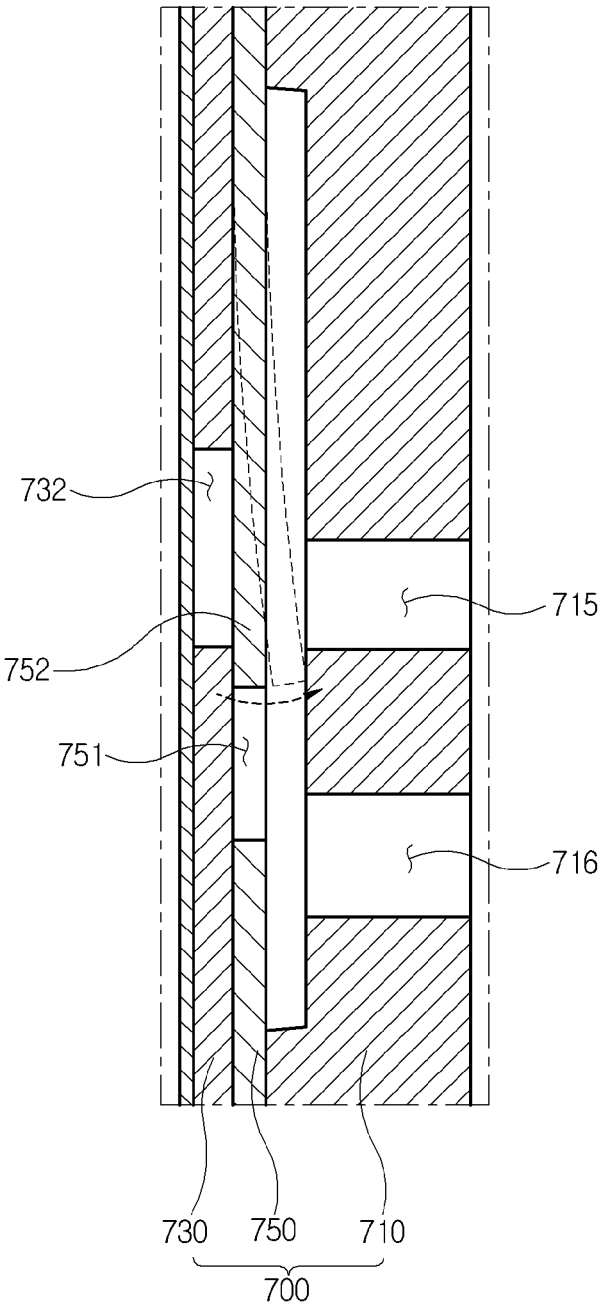
Figure 11:
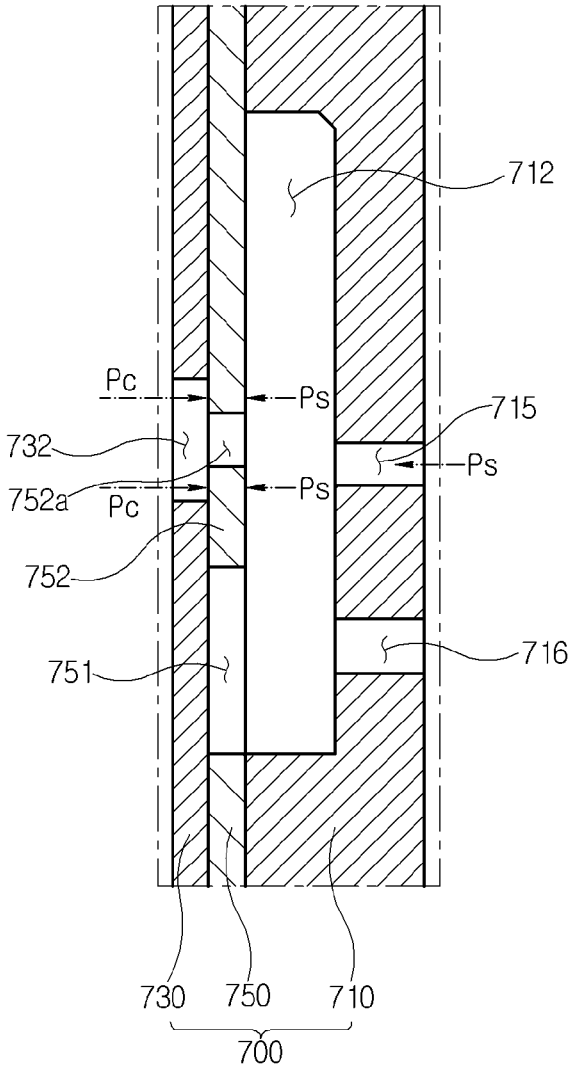
FIGS. 11 and 12 are views illustrating a process of operating the variable reed according to the second embodiment of the present disclosure.
Figure 12:
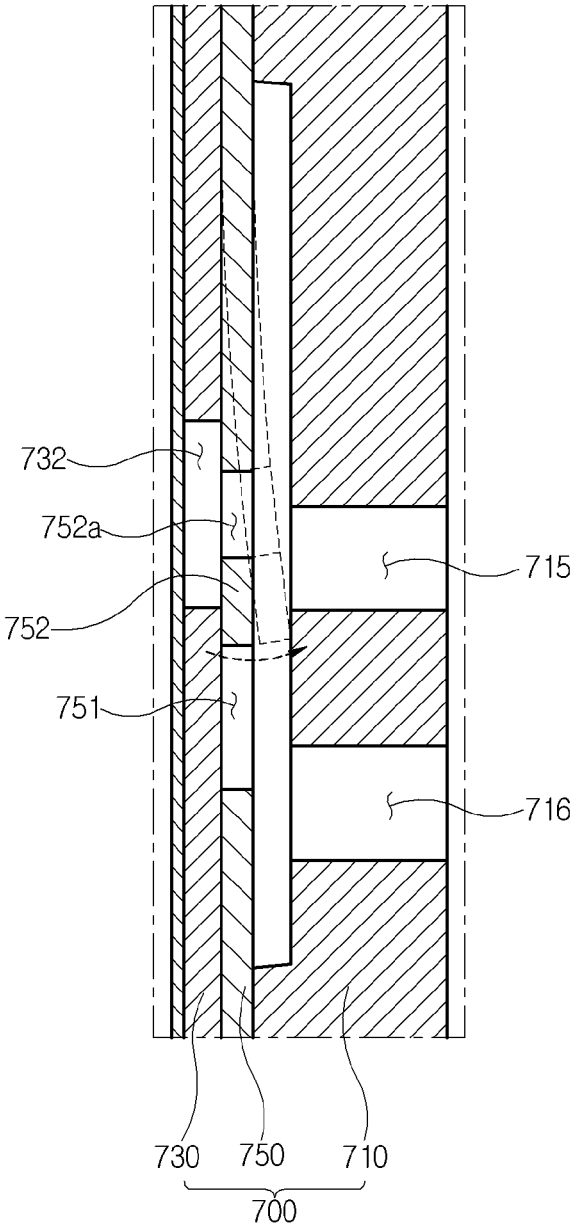
Figure 13:
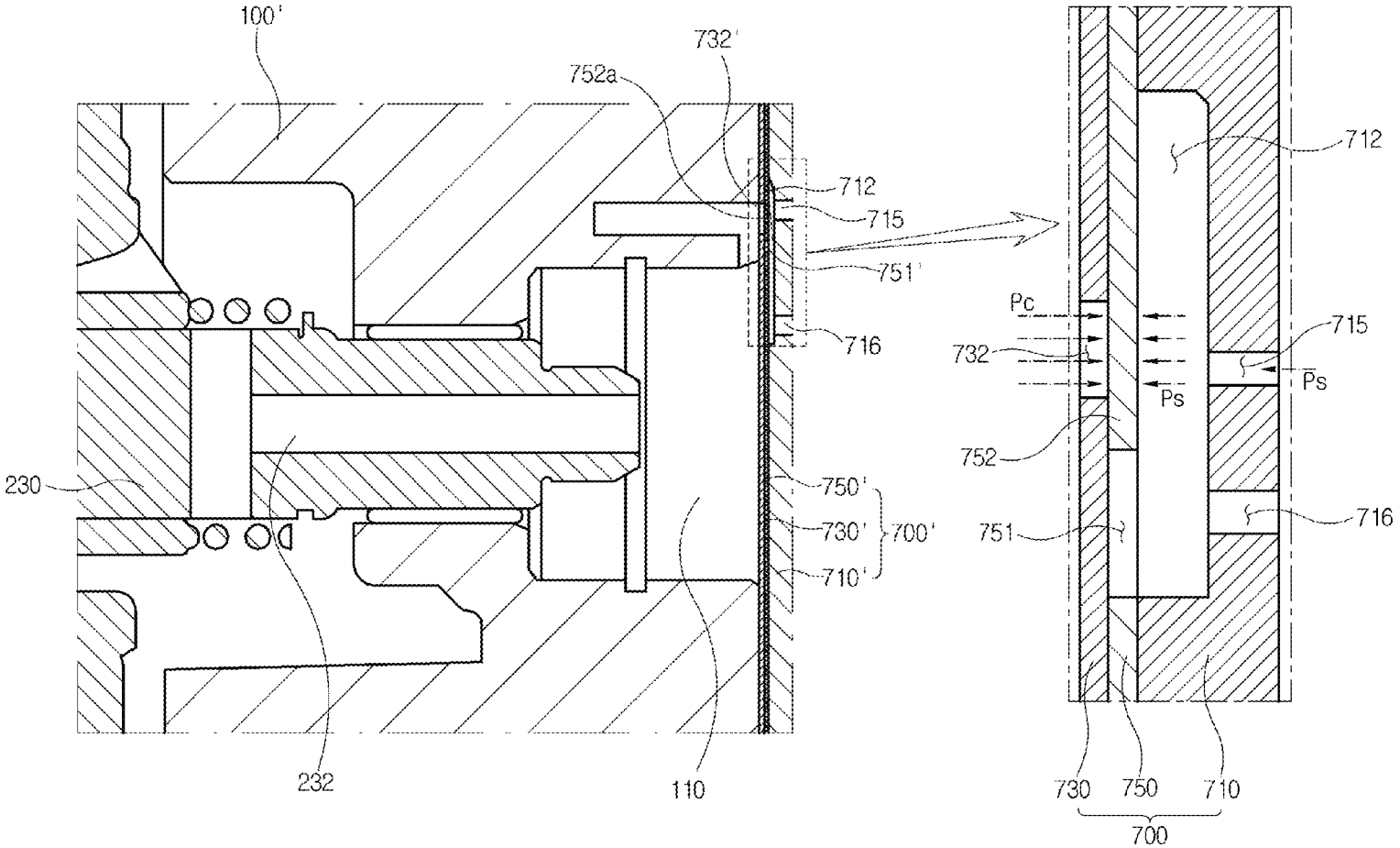
FIG. 13 is an enlarged view of a portion where the variable reed according to the first embodiment of the present disclosure is provided.
Figure 14:
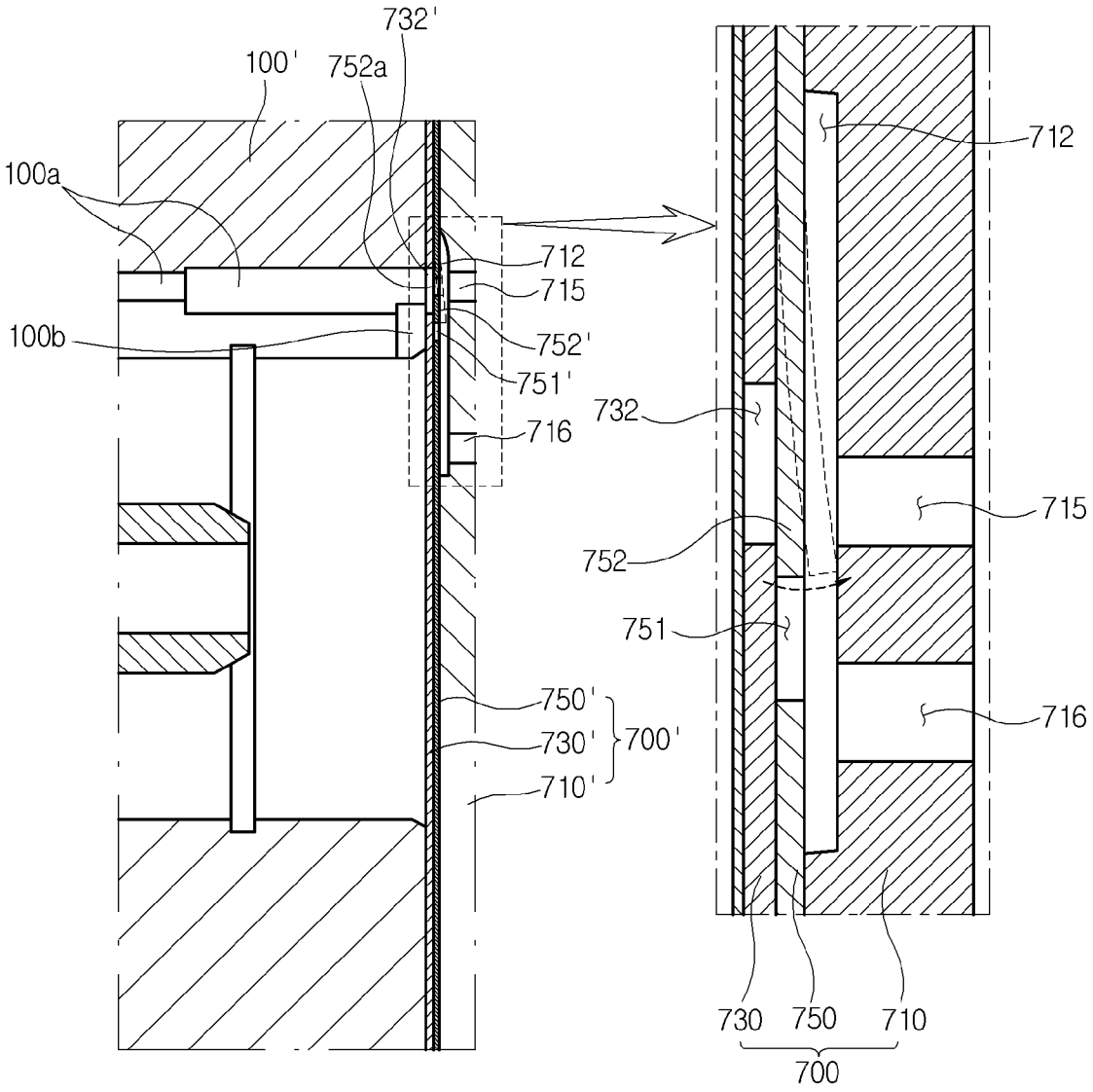
FIG. 14 is an enlarged view of a portion where the variable reed according to the second embodiment of the present disclosure is provided.

FIGS. 9 and 10 are views illustrating a process of operating the variable reed according to the first embodiment of the present disclosure, FIGS. 11 and 12 are views illustrating a process of operating the variable reed according to the second embodiment of the present disclosure, FIG. 13 is an enlarged view of a portion where the variable reed according to the first embodiment of the present disclosure is provided, and FIG. 14 is an enlarged view of a portion where the variable reed according to the second embodiment of the present disclosure is provided.

As illustrated in these drawings, the valve assembly 700 includes the valve plate 710 inserted into the rear housing 300, the gasket 730 inserted into the cylinder block 100, and the suction reed plate 750 inserted between the valve plate 710 and the gasket 730. Further, the discharge assembly 800 includes: the discharge reed 810 having the plurality of discharge reed plates 812 each functioning as a discharge valve for guiding the refrigerant compressed in the cylinder to the discharge chamber 330 only when the pressure of the refrigerant is higher than a predetermined pressure; and the discharge gasket 820 having the retainer 822 provided to regulate the amount of movement of the discharge reed plate 812.

On the basis of the flow of refrigerant, the cylinder block 100 has the through-portion 100*a* formed in the longitudinal direction of the driving shaft 230. In addition, a communication hole 100*b* is formed for communication from the through-portion 100*a* toward the driving shaft 230, such that the refrigerant flowing around the driving shaft 230 is introduced into the communication hole 100*b*. The gasket 730 has the gasket hole 732 formed to correspond to the position of the through-portion 100*a*, and the suction reed plate 750 has the variable reed 752 formed to correspond to the position of the gasket hole 732. The valve plate 710 may have the reed groove 752*a* formed corresponding to the position of the variable reed 752.

The gasket hole 732 is formed in a circular shape at a position corresponding to the position of the through-portion 100*a*, and the gasket hole 732 is penetratively formed in the gasket 730. However, the gasket hole 732 may have any shape that enables the refrigerant to be transferred to the variable reed 752.

The suction chamber pressure-maintaining space 712 is a kind of accommodation space which is a flow space of the variable reed 752 when the variable reed 752 is deformed by the pressure of the refrigerant to open the gasket hole 732 during the flow of the refrigerant. The suction chamber pressure-maintaining space 712 is recessed from the surface of the valve plate and formed on the plate surface facing the suction reed plate 750. In addition, the suction chamber pressure-maintaining space 712 defines a part of the intermediate flow path for supplying the refrigerant to the second orifice hole and also functions as a retainer for restricting the displacement of the variable reed 752. Therefore, the suction chamber pressure-maintaining space 712 needs to have a shape enough to sufficiently accommodate the variable reed 752, and the depth of the suction chamber pressure-maintaining space 712 may be appropriately selected in accordance with a thickness of the variable reed, and types, operating pressures, and flow rates of refrigerants to be supplied.

The first orifice hole 751 is defined as a space in which the variable reed 752 is disposed. The first orifice hole 751 is formed by cutting a portion of the suction reed plate 750 and the variable reed 752 is disposed in the first orifice hole 751. As described above, since the variable reed 752 is larger than the gasket hole 732, the refrigerant flows through the reed hole 752*a* in the state in which the variable reed is closed, and the refrigerant flows throughout the first orifice hole 751 in the state in which the variable reed is opened.

The second valve plate through hole 716, which is the second orifice hole, is formed at a position at which the second orifice hole may communicate with the suction chamber 310. Therefore, a refrigerant discharge flow path leading to the first orifice hole 751→the suction chamber pressure-maintaining space 712→the second valve plate through hole 716 which is the second orifice hole→the suction chamber is defined.

According to the process of operating the variable reed 752 according to the first embodiment of the present disclosure, the variable reed 752 is closed, as illustrated in FIG. 9, when the control pressure Pc, which is the pressure in the control chamber, is lower than the suction pressure Ps. In this case, the variable reed 752 according to the first embodiment of the present disclosure may not have the variable reed hole 752*a*. Meanwhile, when the control pressure Pc is higher than the suction pressure Ps, the variable reed 752 is opened in the direction indicated by the arrow, as illustrated in FIG. 10 in detail, such that the refrigerant is discharged. In the present disclosure, the configuration in which the variable reed 752 may be provided to have the variable reed hole 752*a* having a shape other than the shapes illustrated in FIGS. 9 and 10 is similar to those described above.

In the present embodiment, another refrigerant flow path may be provided in addition to the refrigerant flow path described above. A hollow flow path 232 is formed in the driving shaft 230. The hollow flow path 232 may be a part of an oil discharge flow path for discharging oil introduced into the crank chamber, and the refrigerant in the crank chamber may be thus introduced into the hollow flow path 232. The refrigerant introduced into the hollow flow path 232 is introduced into the buffer space 110 identical to the buffer space according to the first embodiment.

The refrigerant introduced into the buffer space 110 may be introduced into the the gasket hole 732 through the communication groove 100*b* formed at the end of the cylinder block 100, and then introduced into the suction chamber through the refrigerant discharge flow path as described above.

Meanwhile, both the through-portion 100*a* and the hollow flow path 232 may be provided, such that a part of the refrigerant in the crank chamber may be introduced into the first orifice hole 751 along the through-portion 100*a*, and another part of the refrigerant may be introduced into the first orifice hole 751 along the hollow flow path 232 and the communication groove 100*b*.

Since the buffer space 110 is disposed to be connected to all the above-mentioned refrigerant flow paths, it is possible to obtain the above-mentioned effect of the buffer space 110. In particular, it is possible to further reduce a manufacturing process because an existing oil separation flow path may be used as a part of the refrigerant discharge flow path, and it is possible to introduce the refrigerant in the crank chamber more smoothly into the first orifice hole because the flow path supplied with the refrigerant may be further expanded.

In this case, the variable reed 752 may utilize any of those illustrated in FIGS. 4 to 8.

According to the aspects of the present disclosure having the above-mentioned features, in the case in which the variable reed is opened by a difference between the control pressure and the suction pressure, no difference occurs between the suction pressure and the pressing force of the suction pressure to the variable reed, and as a result, it is possible to prevent a delay of opening of the variable reed caused by the difference between the suction pressure and the pressing force of the suction pressure to the variable reed, thereby minimizing an unnecessary outflow of the refrigerant gas. Therefore, the amount of loss of the refrigerant gas is reduced, thereby improving the efficiency of the compressor.

It is obvious to those skilled in the art that the present disclosure is not limited to the aforementioned embodiments and may be variously changed and modified without departing from the spirit and the scope of the present disclosure. The changed and modified examples belong to the claims of the present disclosure.

The invention claimed is:

1. A swash plate compressor comprising a cylinder block configured to accommodate a piston for compressing a refrigerant;

a front housing coupled to a front side of the cylinder block and having a crank chamber;

a rear housing having a suction chamber and a discharge chamber and coupled to a rear side of the cylinder block; and a gasket inserted into the cylinder block, and a suction reed plate inserted between a valve plate and the cylinder block, the swash plate compressor further comprising:

a first orifice hole through which the refrigerant in the crank chamber passes;

a second orifice hole communicating with the suction chamber and configured to discharge the refrigerant passing through the first orifice hole to the suction chamber; and an intermediate flow path configured to connect the first orifice hole and the second orifice hole; and the valve plate inserted between the cylinder block and the rear housing and having a suction chamber pressure-maintaining space connected to the suction chamber and configured to maintain a pressure equal to a pressure in the suction chamber, wherein the valve plate further comprises a first valve plate through hole penetratively formed in the valve plate to connect the suction chamber pressure-maintaining space and the suction chamber; and wherein the second orifice hole is formed from a second valve plate through hole penetratively formed in the valve plate and spaced apart from the first valve plate through hole.

2. The swash plate compressor of claim 1, wherein the suction chamber pressure-maintaining space is recessed in the valve plate.

3. The swash plate compressor of claim 1, further comprising:

a variable reed having one end connected to the suction reed plate, and an other end formed as a free end, wherein an opening degree of the variable reed is changed in accordance with a pressure of the refrigerant.

4. The swash plate compressor of claim 3, wherein the variable reed is provided to be displaced into the suction chamber pressure-maintaining space.

5. The swash plate compressor of claim 4, wherein the first valve plate through hole is provided to be closed when the variable reed is displaced into the suction chamber pressure-maintaining space.

6. The swash plate compressor of claim 5, wherein the gasket comprises a gasket hole formed to face the variable reed such that the refrigerant passes through the gasket hole.

7. The swash plate compressor of claim 6, wherein the variable reed is formed to close the gasket hole and comprises a variable reed hole penetratively formed to face the gasket hole.

8. The swash plate compressor of claim 7, wherein the variable reed hole has a diameter smaller than a diameter of the gasket hole, and the variable reed hole is disposed in a direction of a central axis of the gasket hole so as to be coaxial with the gasket hole.

9. The swash plate compressor of claim 7, wherein the variable reed hole is spaced apart from the first valve plate through hole in an axial direction of the first valve plate through hole with the suction chamber pressure-maintaining space interposed therebetween, and a part of the variable reed hole, which is adjacent to the suction chamber pressure-maintaining space, overlaps a portion of the first valve plate through hole which is adjacent to the suction chamber pressure-maintaining space.

10. The swash plate compressor of claim 9, wherein the free end of the variable reed comes into contact with a portion of the valve plate between the first through hole and the second through hole when the variable reed is opened.

11. The swash plate compressor of claim 9, wherein the variable reed is formed to open at least a part of the gasket hole.

12. The swash plate compressor of claim 1, wherein the cylinder block has a through-portion extending between the crank chamber and the first orifice hole.

13. The swash plate compressor of claim 12, wherein the first orifice hole is formed in the suction reed plate.

14. The swash plate compressor of claim 1, wherein the intermediate flow path comprises a buffer space communicating with the suction chamber pressure-maintaining space.

15. The swash plate compressor of claim 14, wherein the buffer space is disposed between one end of the cylinder block and the gasket.

16. The swash plate compressor of claim 15, wherein the buffer space communicates with the second orifice hole.

17. A swash plate compressor comprising:

a cylinder block configured to accommodate a piston for compressing a refrigerant;

a front housing coupled to a front side of the cylinder block and having a crank chamber;

a rear housing having a suction chamber and a discharge chamber and coupled to a rear side of the cylinder block; and a gasket inserted into the cylinder block, and a suction reed plate inserted between a valve plate and the cylinder block, the swash plate compressor further comprising:

a first orifice hole through which the refrigerant in the crank chamber passes;

a second orifice hole communicating with the suction chamber and configured to discharge the refrigerant passing through the first orifice hole to the suction chamber;

an intermediate flow path configured to connect the first orifice hole and the second orifice hole; and the valve plate inserted between the cylinder block and the rear housing and having a suction chamber pressure-maintaining space connected to the suction chamber and configured to maintain a pressure equal to a pressure in the suction chamber; and a variable reed having one end connected to the suction reed plate, and the other end formed as a free end, wherein an opening degree of the variable reed is changed in accordance with a pressure of the refrigerant, wherein the first orifice hole is formed along a part of an outer circumferential portion of the variable reed.

* * * * *